US005501151A

United States Patent [19]

Thureson et al.

[11] Patent Number: 5,501,151

[45] Date of Patent: Mar. 26, 1996

[54] ALTERNATE SIGNAL PATH ISOLATION MEMBER AND NON-ELECTRIC DETONATOR CAP INCLUDING THE SAME

[75] Inventors: Gary R. Thureson, Avon; Eric R. Davis, Torrington; Steven R. Pellon, Winsted; Alvaro Zappalorti, Avon; Ernest L. Gladden, Granby, all of Conn.

[73] Assignee: The Ensign-Bickford Company, Simsbury, Conn.

[21] Appl. No.: 327,204

[22] Filed: Oct. 21, 1994

[51] Int. Cl.[6] ..... C06C 5/04; C06C 7/00

[52] U.S. Cl. ..... 102/275.7; 102/275.3; 102/275.12

[58] Field of Search ..... 102/275.2, 275.3, 102/275.4, 275.5, 275.6, 275.7, 275.12

[56] References Cited

U.S. PATENT DOCUMENTS

| | | | |
|---|---|---|---|
| 3,981,240 | 9/1976 | Gladden | 102/29 |
| 4,742,773 | 5/1988 | Bartholomew et al. | 102/275.3 |
| 5,031,538 | 7/1991 | Dufrane et al. | 102/275.5 |
| 5,365,851 | 11/1994 | Shaw | 102/275.6 |

FOREIGN PATENT DOCUMENTS 1046812 1/1979 Canada .

OTHER PUBLICATIONS

Drawing No. 92C 349D of The Ensign–Bickford Company.

*Primary Examiner*—Charles T. Jordan
*Assistant Examiner*—Theresa M. Wesson
*Attorney, Agent, or Firm*—Victor E. Libert; Frederick A. Spaeth

[57] ABSTRACT

An isolation member (34) for use in a non-electric detonator cap (10) is of substantially cylindrical shape and has an interior passageway (40) extending therethrough and defining a positioning region (44) and a discharge port (56). Positioning region (44) is dimensioned and configured to snugly receive and seat therein a signal transmission line (30) and to orient the signal-emitting end (30*a*) thereof to aim along the longitudinal axis of cap (10) through a diaphragm (42) at the target provided by receptor charge (14). The isolation member is positioned between, and spaces the signal-emitting end (30*a*) of the signal transmission line (30) from, the receptor charge (14) contained in the detonator cap. The isolation member comprises grooves (58, 58*a*, 58*b*) to provide an alternate flow path through which a signal emitted by the discharge end (30*a*) of a signal transmission line (30) can reach the receptor charge (14) should the signal fail to burst the diaphragm (42). The isolation member is preferably made of a semi-conductive material to bleed off to the shell (12) any static electricity charges transmitted through the signal transmission line (shock tube 30) so as to prevent static discharge initiation of the charge.

15 Claims, 5 Drawing Sheets

FIG. 2A
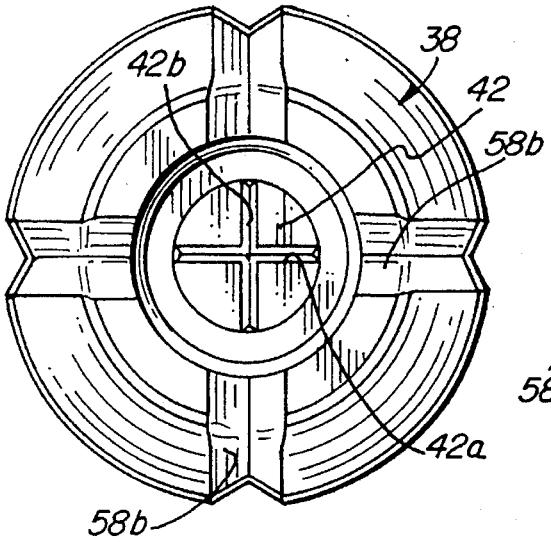
FIG. 2B
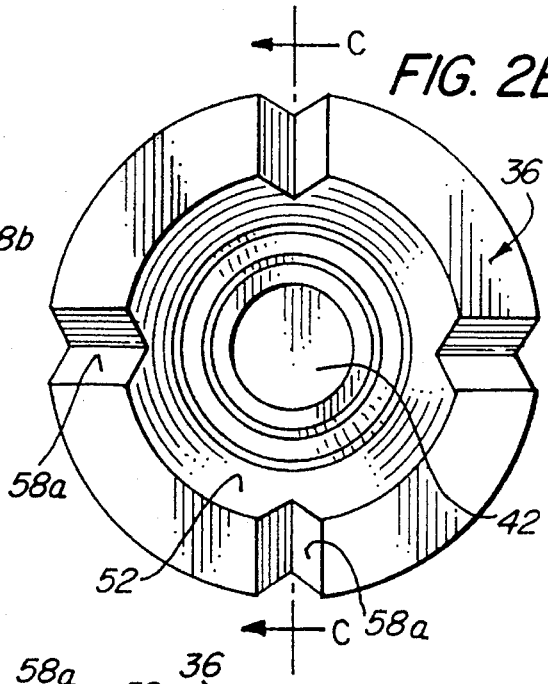
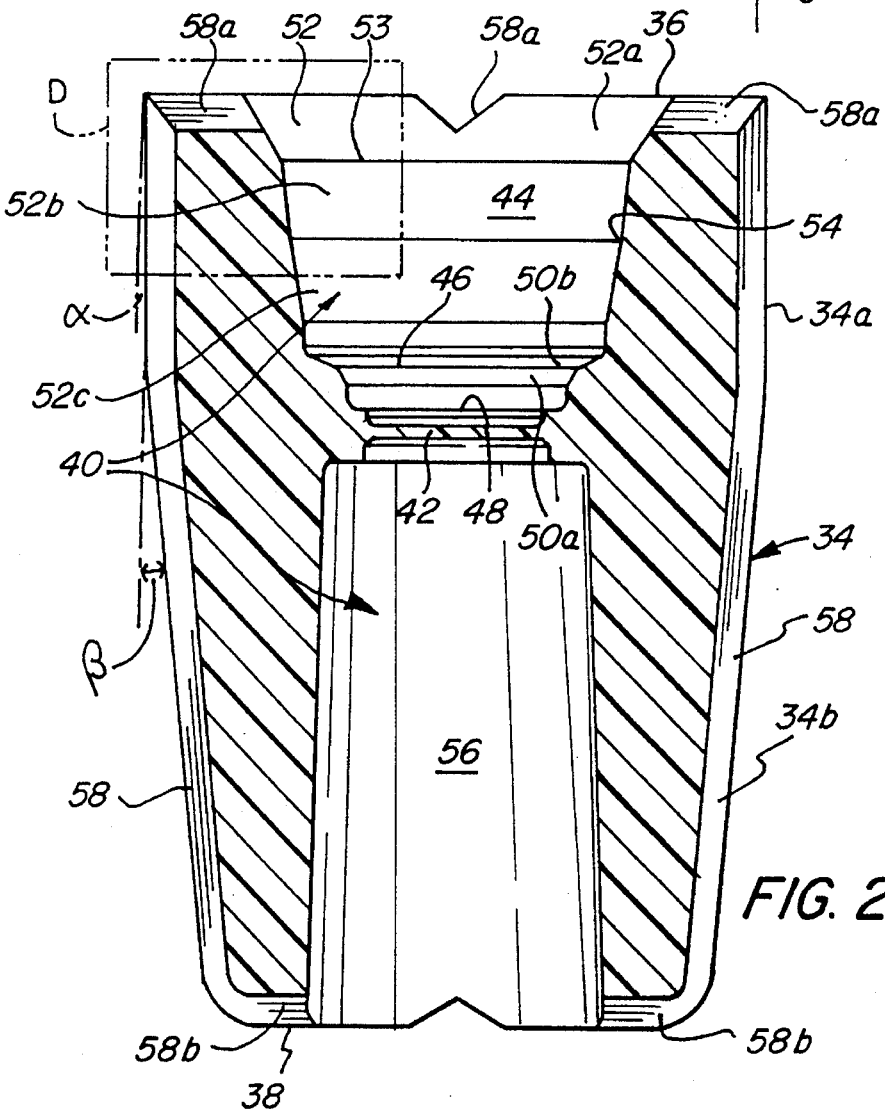
FIG. 2C

ALTERNATE SIGNAL PATH ISOLATION MEMBER AND NON-ELECTRIC DETONATOR CAP INCLUDING THE SAME

BACKGROUND OF THE INVENTION

1. Field of the Invention

The present invention concerns an improved isolation member for use in a non-electric detonator cap and an improved detonator cap including the same. More particularly, the present invention concerns an isolation member that provides alternate paths by which a signal emitted by a signal transmission line can reach a pyrotechnic or explosive charge in the detonator cap.

2. Related Art

The use of isolation members in non-electric detonator caps which are to be assembled to fuses of a type capable of transmitting a static electric charge is known in the art, as shown by U.S. Pat. No. 3,981,240 issued Sep. 21, 1976 to E. L. Gladden. That Patent discloses the use of signal transmission lines, i.e., fuses, of the type disclosed in U.S. Pat. No. 3,590,739 issued Jul. 6, 1971 to P. A. Persson. Such fuses, commonly referred to as "shock tubes", comprise an elongated hollow tube made of one or more synthetic organic polymeric material(s) (plastics) containing on the interior wall thereof a coating of reactive material such as a pulverulent high explosive and reducing agent, for example, PETN or HMX and aluminum powder. The coating of reactive material on the interior wall is quite thin and leaves the tube hollow, providing an open channel or bore extending the length of the tube. When the reactive material is ignited, as by a spark igniter or a detonator cap used as a signal transmitter, or any other suitable means, ignition of the reactive material propagates an initiation signal through the bore of the tube. If the tube is properly connected to a receptor detonator cap, the initiation signal will initiate detonation of the cap. (As used herein, the "receptor" detonator cap is the cap which is to be detonated by the initiation signal transmitted through the tube or other signal transmission line.)

Other patents concerning such shock tubes and the manufacture thereof include U.S. Pat. No. 4,328,753, issued May 11, 1982 to L. Kristensen et al and U.S. Pat. No. 4,607,573 issued Aug. 26, 1986 to G. R. Thureson et al. As disclosed in the Thureson et al Patent, the reactive material may comprise a thin coating or dusting of a mixture of an explosive such as PETN, RDX, HMX or the like, and a fine aluminum powder, and the shock tube may be a plural-layer tube. For example, as disclosed in the Kristensen et al Patent, the inner tube may comprise a plastic, such as a SURLYN™ ionomer, to which the reactive powder will adhere and the outer tube may be made of a mechanically tougher material such as low or medium density polyethylene. (SURLYN is a trademark of E. I. Du Pont de Nemours & Co. for its ionomer resins.)

U.S. Pat. No. 4,757,764 issued Jul. 19, 1988 to G. R. Thureson et al discloses signal transmission lines comprising tubes as described above except that instead of an explosive powder of high brisance (e.g., PETN or HMX), the reactive material is a low velocity deflagrating material. Use of a deflagrating material provides a reduced speed of transmission of the initiation signal propagated through the tube as compared to shock tubes. Such deflagrating material tubes are referred to as low velocity signal transmission lines ("LVST® lines"). Numerous deflagrating materials are disclosed in U.S. Pat. No. 4,757,764, including manganese/potassium perchlorate, silicon/red lead, and zirconium/ferric oxide, to name but a few of the many disclosed in that Patent starting at column 3, line 48. As pointed out at column 4, line 47 et seq. of that Patent, LVST® lines transmit an initiation signal by means of a "pressure/flame front" principle whereas shock tubes, when ignited, produce a "shock wave initiation signal" which travels through the tube. Both types of tubes, shock tubes and LVST®lines, as well as detonating cords, especially low-energy detonating cords, may be used to initiate detonator caps for use in demolition, mining and other systems. Such tubes and cords are collectively referred to herein and in the claims as "signal transmission lines".

Signal transmission lines of the type comprising a tube containing a metallic powder such as aluminum as part of the reactive material are capable of transmitting a static electric charge which may result in premature detonation of the receptor detonator cap, which can of course have catastrophic results. Accordingly, the invention of the above-mentioned Gladden U.S. Pat. No. 3,981,240 provides a fuse-retaining bushing (28) made of a semi-conductive plastic material. The bushing provides a "stand-off", i.e., a space, between the signal-emitting end of the initiating fuse (26) and the target of the initiation signal which, as illustrated in the Gladden Patent, is a primer or booster charge (20). The bushing isolates the signal-emitting end of the signal transmission line from the target by a thin, flat rupturable membrane (40). The bushing further provides a shunt path for transmitting static electric charges from the signal-emitting end of the initiator fuse to the metallic shell or casing (12) of the detonator cap, thereby bleeding off static charges before they reach a potential high enough to cause a spark which could penetrate the membrane and ignite the cap charge to prematurely detonate the cap.

SUMMARY OF THE INVENTION

The present invention provides for an isolation member for positioning the signal-emitting end of a non-electric signal transmission line within the shell of a detonator cap. The isolation member comprises a substantially cylindrical body dimensioned and configured to be received within the shell of the detonator cap and has an exterior surface, an input end, and an output end. An interior passageway extends through the body to allow for transmission therethrough of an initiation signal from the input end to the output end of the body. The interior passageway also defines a positioning region at the input end of the body and a discharge port at the output end of the body. The isolation member further comprises an alternate flow path connecting the input end of the body in initiation signal communication with the discharge port. The alternate flow path comprises one or more grooves extending from the input end of the body, along the exterior surface thereof, and thence to the output end of the body and to the discharge port.

According to one aspect of the invention, the alternate flow path may comprise one or more signal paths, each signal path comprising a generally longitudinally-extending groove formed in the exterior surface of the body, and an input radial groove at the input end of the body and an output radial groove at the output end of the body associated therewith. The associated input, longitudinal and output grooves may be in initiation signal communication with each other to define one or more signal paths.

According to another aspect of the invention, the alternate flow path may comprise a plurality of signal paths spaced equiangularly about the circumference of the body. For example, there may be four signal paths spaced at ninety-degree intervals about the circumference of the body.

According to still another aspect of the invention, the total cross-sectional flow area of the alternate flow path may equal at least about 20 percent of the cross-sectional flow area of the interior passageway measured at its smallest point.

Yet another aspect of the invention provides that the isolation member may have a signal-rupturable diaphragm disposed within the interior passageway to isolate the positioning region from the discharge port.

Preferably, the body of the isolation member is substantially entirely comprised of a semi-conductive synthetic polymeric material.

The present invention also provides a detonator cap for connection to a length of non-electric signal transmission line terminating in a signal-emitting end. The detonator cap comprises an elongated shell having an open end for receiving the non-electric signal transmission line and an opposite, closed end. A retainer bushing is positioned in the open end of the shell and has a bore extending therethrough for receiving therein a segment of the length of signal transmission line. The retainer bushing connects the signal transmission line to the shell with the signal-emitting end enclosed within the shell. The detonator cap includes a receptor charge positioned within the shell and disposed between the bushing and the closed end of the shell and axially spaced from the bushing. Finally, the detonator cap includes an isolation member as described above disposed within the shell in the space between the bushing and the receptor charge.

The detonator cap may further include a length of signal transmission line connected to the shell and extending through the bore of the bushing with its signal-emitting end of the transmission line seated in the positioning region of the isolation member.

Other aspects of the present invention are set forth in the following description and the drawings.

BRIEF DESCRIPTION OF THE DRAWINGS

FIG. 2A is an end view of output end 38 of the isolation member of FIG. 2;

FIG. 2B is an end view of input end 36 of the isolation member of FIG. 2;

FIG. 2C is a cross-sectional view, enlarged with respect to FIG. 2B, taken along line C—C of FIG. 2B;

DETAILED DESCRIPTION OF THE INVENTION

AND PREFERRED EMBODIMENTS THEREOF

Figure 1:
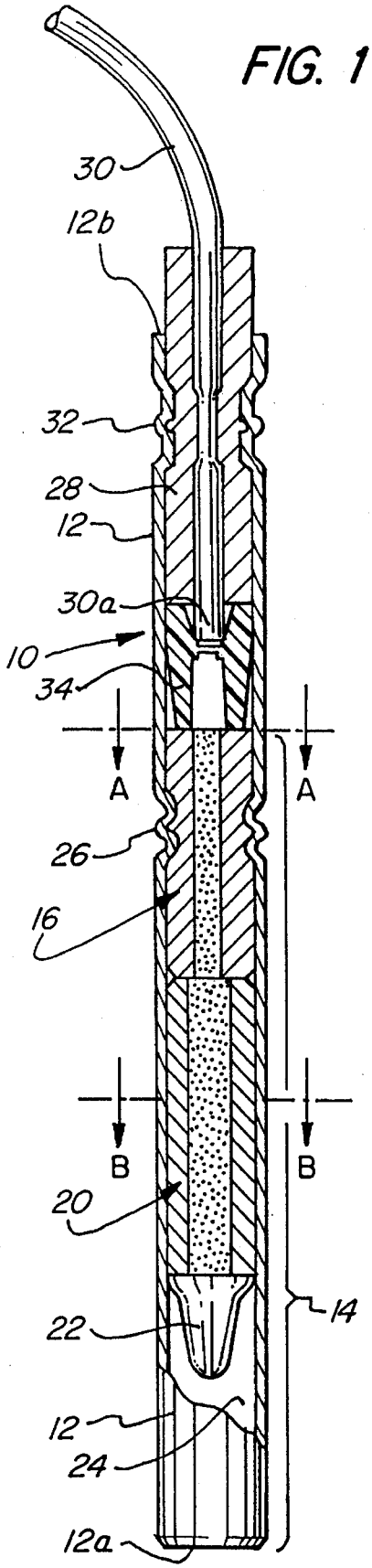
FIG. 1 is a side view, with parts broken away, of a detonator cap having incorporated therein an isolation member in accordance with one embodiment of the present invention.

Referring now to FIG. 1, an embodiment of a receptor detonator cap in accordance with the present invention is generally indicated at 10 and comprises a tubular casing or shell 12 made of a suitable plastic or metal, such as a semi-conductive plastic material or, as in the illustrated embodiment, aluminum. Shell 12 has a closed end 12*a* and an opposite, open end 12*b*. A signal transmission line comprises, in the illustrated embodiment, a shock tube 30 having a signal-emitting end 30*a* which is connected to shell 12 as more fully described below. A receptor charge generally indicated at 14 is enclosed within shell 12 and is comprised of, in the illustrated embodiment, a sealer element 16, a delay element 20, a primary explosive charge 22, e.g., lead azide or DDNP (diazodinitrophenol), and a secondary explosive charge 24, e.g., PETN. As those skilled in the art will appreciate, receptor charge 14 may include more or fewer elements than those illustrated in FIG. 1. Thus, sealer element 16 and delay element 20 may be eliminated so that receptor charge 14 may comprise only one or more explosive charges, such as primary and secondary charges 22, 24, to provide an instantaneous-acting detonator cap. In other instan- taneous-acting caps the primary explosive charge 22 is omitted, so that the receptor charge 14 simply comprises the secondary explosive charge 24. In other detonator cap configurations, the receptor charge 14 may comprise, in addition to sealer element 16 and delay element 20, an additional, highly exothermic pyrotechnic element disposed between the sealer element and the delay element in cases where the delay element core is a relatively insensitive composition. This type of arrangement is illustrated in FIG. 1D, wherein parts identical to those of FIG. 1 are identically numbered and the description thereof is not repeated. As shown in FIG. 1D, a detonator cap 10' includes, in addition to the components of detonator cap 10 of FIG. 1, a starter element 18 which comprises a pyrotechnic core 18*a* and a sheath 18*b*. In other known constructions, elements 16, 18 and 20 of FIG. 1D may be replaced by what is referred to as a "rigid element". Such rigid element comprises a unitary sheath which contains in sequence (as sensed moving from open end 12*b* towards closed end 12*a*) a pyrotechnic core, a primary explosive core and a secondary explosive core. Such rigid element may be used in place of sealer element 16, starter element 18 and delay element 20. Alternatively, a sealer element 16 may be deployed adjacent to the rigid element, on the side thereof facing the open end of the detonator. Another known variation is a detonator which contains a delay element 20, but no sealer element 16 or starter element 18. Generally, any known type of detonator construction may be used in connection with the invention. Accordingly, receptor charge 14, which provides the target for the signal (e.g., that emitted from the discharge or signal-emitting end 30*a* of shock tube 30) may provide either a pyrotechnic or an explosive charge target.

Figure 1B:
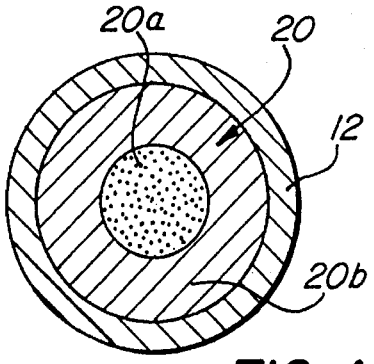
FIGS. 1A and 1B are cross-sectional views, enlarged with respect to FIG. 1, taken along, respectively, lines A—A and B—B of FIG. 1.
Figure 1A:
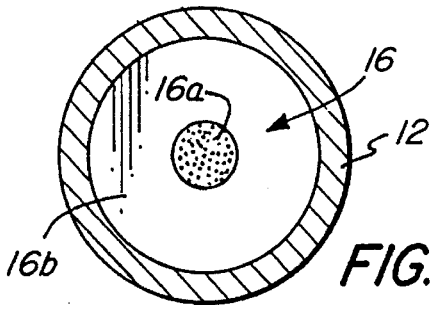

As shown in FIGS. 1A and 1B, the sealer and delay elements 16, 20 each comprise respective pyrotechnic cores 16*a* and 20*a* encased within suitable respective sheaths 16*b* and 20*b*. The sheaths 16*b* and 20*b* conventionally comprise a material such as lead or aluminum which may readily be deformed by pressure or crimping. Thus, a crimp 26 may be formed in shell 12 to slightly deform lead sheath 16*b*, thereby securely sealing and retaining receptor charge 14 positioned within shell 12. Alternatively, the sheath may be pressed after it is placed within the shell, using a press pin. In response to the pressure, the sheath will expand and seal against the inside wall of the shell. In other cases, the sheath may be sized to have an outside diameter which is equal to or slightly larger than the inside diameter of shell 12, to provide an interference-fit.

In the embodiment illustrated in FIG. 1, receptor charge 14 includes a pyrotechnic train comprised of elements 16 and 20 and an explosive charge comprised of primary and secondary explosive charges 22 and 24. Receptor charge 14 occupies only a portion of the length of shell 12, and is disposed adjacent the closed end 12*a* thereof. The open end 12*b* of shell 12 is fitted with a retainer bushing 28 and receives one end of a length of fuse which may comprise any suitable signal transmission line, e.g., shock tube 30 as illustrated or an LVST® line or a low-energy detonating cord. The signal-emitting end 30*a* of shock tube 30 is enclosed within shell 12. A crimp 32 is formed at or in the vicinity of open end 12*b* of shell 12 in order to grip retainer bushing 28 and shock tube 30 in place and to seal the interior of shell 12 against the environment. Accordingly, retainer bushing 28 is usually made of a resilient material such as a suitable rubber or elastomeric polymer. Shock tube 30 is of conventional construction, comprising a laminated tube having an outer tube 30*b* seen in FIG. 1C which may be made of polyethylene, extruded over, or co-extruded with, a sub-tube 30*c* which may be made of a polymer, such as a SURLYN™ionomer, to which the reactive powder adheres. Alternatively, a monolayer tube may be employed. A dusting 30*d* of reactive powder (greatly exaggerated in thickness in FIG. 1C for clarity of illustration) clings to the inner wall provided by the inside surface of sub-tube 30*c*.

Isolation member 34 is interposed between the sig- nal-emitting end 30*a* of shock tube 30 and the input end of the receptor charge 14 which, in the embodiment of FIG. 1, is the end of sealer element 16 which faces the open end 12*b* of shell 12. As best appreciated with respect to FIG. 1A, the target area which the signal emitted from shock tube 30 must strike and ignite in order for the detonator cap 10 to properly function is, in the illustrated embodiment, the limited area provided by the exposed ignition face end of pyrotechnic core 16*a*. If tube 30 is not aligned along the longitudinal axis of shell 12, for example, if tube 30 is curved at or near the signal-emitting end 30*a* thereof as suggested in FIG. 3A, the signal emitted from signal-emitting end 30*a* may not squarely strike pyrotechnic core 16*a*, but all or part of it may instead strike sheath 16*b*, thereby causing a misfire. Isolation member 34 is designed to prevent such curving of tube 30 and consequent misfiring.

Figure 1C:
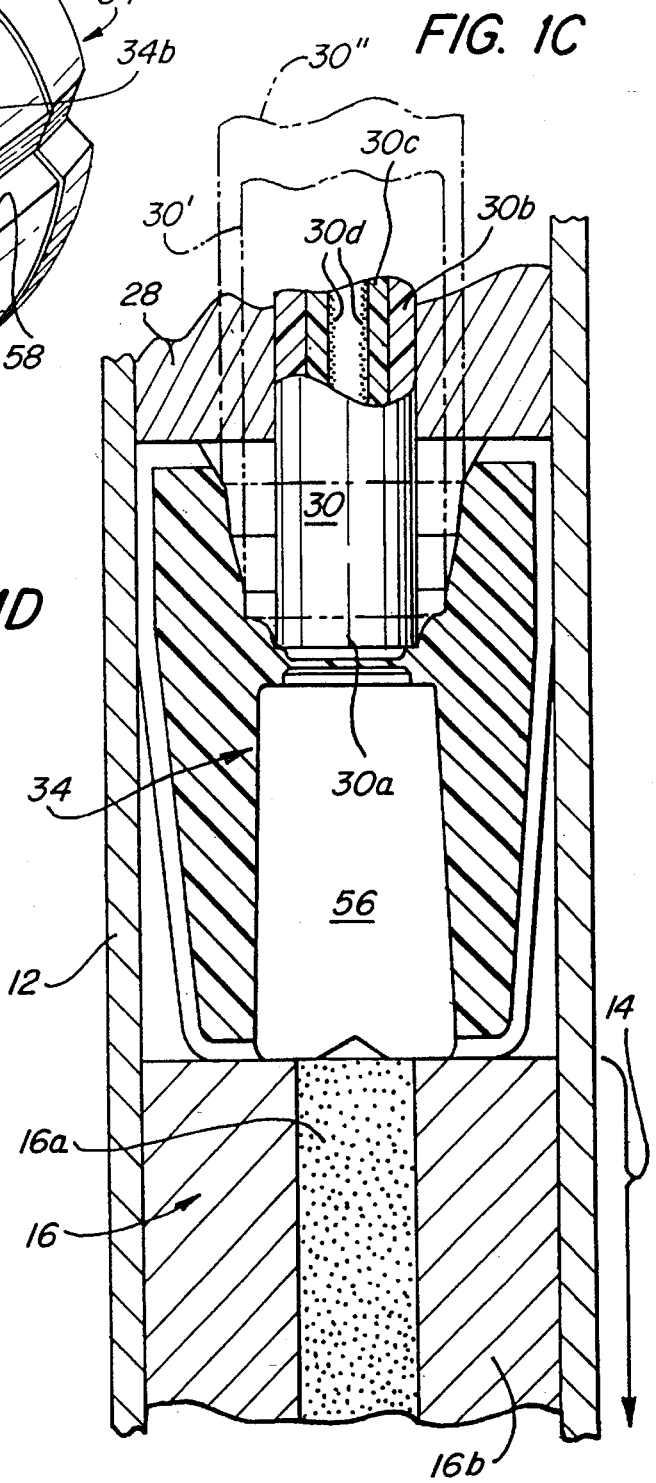
FIG. 1C is an enlarged view of the portion of FIG. 1 containing the isolation member.
Figure 1D:
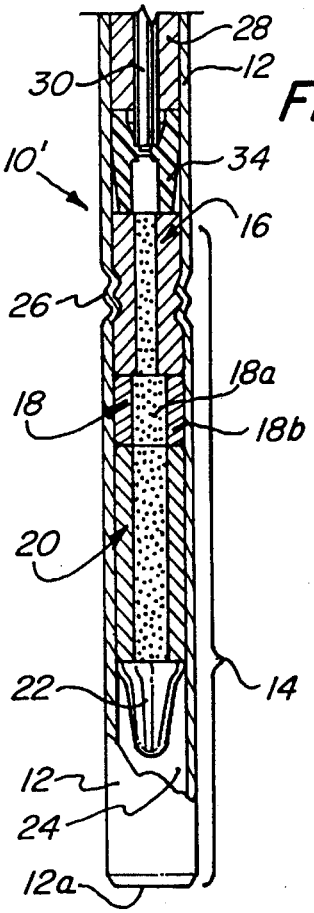
FIG. 1D is a reduced-size (relative to FIG. 1) view of another embodiment of a detonator cap generally corresponding to that of FIG. 1, except that the upper part of the drawing is broken away.

Referring now to FIG. 1C, isolation member 34 is seen to be seated upon the ignition face end of sealer element 16 with discharge port 56 aligned with pyrotechnic core 16*a*. It will be noted that although generally substantially cylindrical in shape, isolation member 34 tapers slightly inwardly in moving from the direction of its input end 36 towards its output end 38. As seen in FIG. 2C, a first section 34*a* of isolation member 34 has a taper angle β of, e.g., about 1 degree or less, and the longitudinally longer second section 34*b* has a slightly larger taper angle β of, e.g., from about 1 to 5 degrees. This dual-tapered configuration facilitates both removal of isolation member 34 from the mold in which it is formed and insertion of isolation member 34 into snug-fitting contact, for example, an interference or force fit, with the interior of shell 12. As described above, the taper angle α of the first section 34*a* of isolation member 34 is significantly smaller than the taper angle β of the second, longer section 34*b* of isolation member 34. By utilizing this construction, a sufficiently large taper, angle β, is attained to facilitate mold release and insertion of isolation member 34 into shell 12, while the smaller taper, angle α, at the first section 34*a* minimizes tilting of isolation member 34 out of alignment with the longitudinal center axis of detonator cap 10 after insertion of isolation member 34 into shell 12. The smaller taper of first section 34*a* provides a region of increased wall contact between isolation member 34 and the interior wall of shell 12, thereby eliminating or at least reducing the tendency of isolation member 34 to tilt out of longitudinal alignment. The length (along the longitudinal axis of member 34) of first section 34*a* may be increased relative to the length of second section 34*b* to facilitate maintaining proper alignment of member 34 within shell 12.

As is known in the art, for example, from the abovementioned E. L. Gladden U.S. Pat. No. 3,981,240, isolation member 34 may be molded of a semi-conductive synthetic organic polymeric material. Thus, a suitable polymer may have carbon black or other conductive material mixed therein in order to render isolation member 34 electrically semi-conductive. The term "semi-conductive" is used herein in a broad sense. It embraces a range of conductivity which will cause any static electric charge which tends to build up in the interior of shock tube 30 to be conducted from signal-emitting end 30*a* thereof radially through the body of isolation member 34 and be grounded to the metal (or semi-conductive plastic) shell 12 of detonator cap 10 before sufficient potential builds up to cause a spark. Unless so grounded, a static electricity spark discharge could cause unintended ignition of reactive material 30*d* on the interior wall of shock tube 30 or of discharged reactive powder accumulated on the signal-rupturable diaphragm 42, or could penetrate signal-rupturable diaphragm 42 and discharge port 56 to prematurely ignite receptor charge 14.

Figure 2:
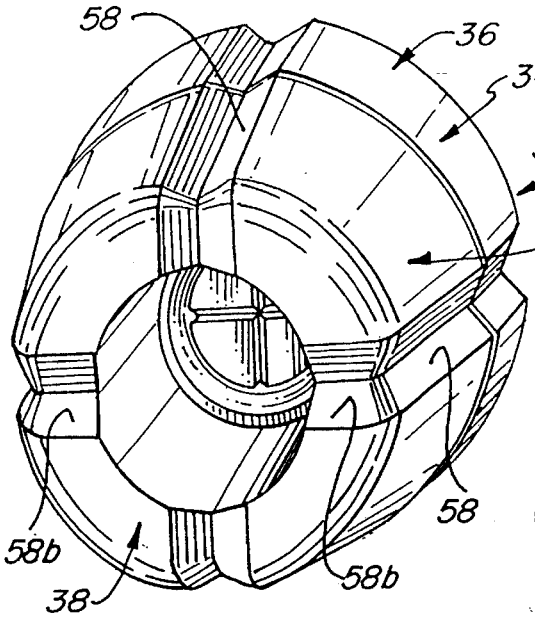
FIG. 2 is a perspective view of the isolation member of FIG. 1.

Referring now to FIGS. 2 to 2C, isolation member 34 is seen to have a substantially cylindrical body and an input end 36 and an output end 38. An interior passageway 40 (FIG. 2C) is comprised of a positioning region 44 which opens to the input end 36 of isolation member 34, and a discharge port 56 which opens to the output end 38 of isolation member 34. Interior passageway 40 is seen to be concentrically disposed about the longitudinal axis of isolation member 34 and extends therethrough from input end 36 to output end 38. A signal-rupturable diaphragm 42 is disposed within interior passageway 40 and separates positioning region 44 from discharge port 56.

Preferably, positioning region 44, as best seen in FIG. 2C, provides a centering shoulder 54 which helps to guide the entry of the end of the signal transmission line (shock tube 30 in the embodiment of FIG. 1) into isolation member 34. In addition, positioning region 44 preferably comprises positioning means comprising a plurality (two in the embodiment illustrated in FIG. 2C) of stepped shoulders 46, 48 which provide seats for signal transmission lines (e.g., shock tubes) 30, 30' (shown in dotted outline in FIG. 1C) of differing sizes and strengths, and to dispose the signal-emitting ends of such lines at a suitable set-off distance from the receptor charge 14. The respective inside and outside diameters of the sizes of shock tube or other signal transmission line and their respective loadings of reactive material (e.g., reactive material 30*d* in the case of shock tube 30) are such that the different spacings between the end of receptor charge 14 and the signal-emitting ends (30*a* in the case of shock tube 30) of the signal transmission line are appropriate for reliable ignition of receptor charge 14 by the signal emitted from the particular signal transmission line employed. Shoulders 46 and 48 are separated by longitudinally extending stepped chamfers 50*a*, 50*b* which decrease in diameter as sensed moving from input end 36 towards output end 38.

Positioning region 44 terminates at the signal-rupturable diaphragm 42. Diaphragm 42 isolates the target provided by receptor charge 14, which in the illustrated embodiment is pyrotechnic core 16*a*, from electrostatic discharge, which is diverted to shell 12 by isolation member 34 as described above, and prevents any dislodged reactive material 30*d* from accumulating on top of the inlet face of pyrotechnic core 16*a*, as is known in the art. The signal emitted from shock tube 30 is sufficiently powerful to rupture diaphragm 42 so that the signal extends to the inlet face of pyrotechnic core 16*a*.

The remaining portion of interior passageway 40 is comprised of a discharge port 56 which is separated from positioning region 44 by the diaphragm 42. By centering shock tube 30 in the isolation member, positioning region 44 helps to focus the output signal at the weakest point on the diaphragm 42. Thus, the likelihood that the diaphragm will rupture upon receiving the signal is enhanced. As seen in FIG. 2A, diaphragm 42 has a pair of grooves 42*a*, 42*b* formed therein, which intersect at about the center of diaphragm 42 to facilitate rupturing of the diaphragm 42 by the signal emitted from signal-emitting end 30*a* of shock tube 30. This provides enhanced reliability of operation as more fully described in co-pending patent application Ser. No. 08/327,186, filed Oct. 21, 1994, entitled, "Isolation Member With Improved Static Discharge Barrier and Non-Electric Detonator Cap Including the Same".

As best seen in FIGS. 2, 2A and 2C, isolation member 34 has a plurality (four in the illustrated embodiment) of exterior grooves 58 extending longitudinally along the exterior surface thereof. As described more fully below, longitudinal grooves 58 extend to connect to input end radial grooves 58a and output end radial grooves 58*b*. The use of exterior generally longitudinal grooves on the outer longitudinal surface of the isolation member is a known expedient in the art to facilitate inserting the isolation member into the shell 12 of detonator cap 10, the fit of a member such as the isolation member 34 in shell 12 being a snug one, for example, an interference or force fit. The known grooves extending longitudinally along the exterior surface provide a flow path for air to escape past the isolation member from the closed end 12*a* of shell 12 as the isolation member is force-fit or otherwise inserted into the shell 12, thereby lessening both the resistance to smooth insertion of the isolation member and the possibility of the expelled air rupturing diaphragm 42.

However, in accordance with the present invention, each conventional longitudinal groove 58 is connected at its opposite ends to a radial groove on both the input end and output end of the isolation member 34, which radial grooves join the opposite ends of the longitudinal exterior grooves 58 to define a signal flow path that extends about the exterior of isolation member 34 from positioning region 44 to discharge port 56 thence to the target provided by the receptor charge 14. Thus, as illustrated in FIGS. 2, 2A, 2B and 2C, longitudinal grooves 58 are extended radially around both the input end 36 and output end 38 of the isolation member 34, by the provision of input radial grooves 58*a* at the input end and output radial grooves 58*b* at the output end, so that four continuous signal flow paths about the exterior of the isolation member 34 are formed between input end 36 and the output end 38 of discharge port 56 of the isolation member 34. Grooves 58*a* and 58*b* are dimensioned and configured so that an initiation signal can flow from input end 36, about the exterior of the isolation member and to discharge port 56, i.e., the grooves are in initiation signal communication with each other.

In normal operation a signal that has travelled along shock tube 30 is emitted from the signal-emitting end 30*a* thereof, and bursts diaphragm 42 to reach receptor charge 14. However, without wishing to be bound by any particular theory, it is believed that providing such an alternate flow path between input end 36 and discharge port 56 improves the reliability with which an initiation signal is transferred to the receptor charge in at least one of several instances.

Figure 3A:
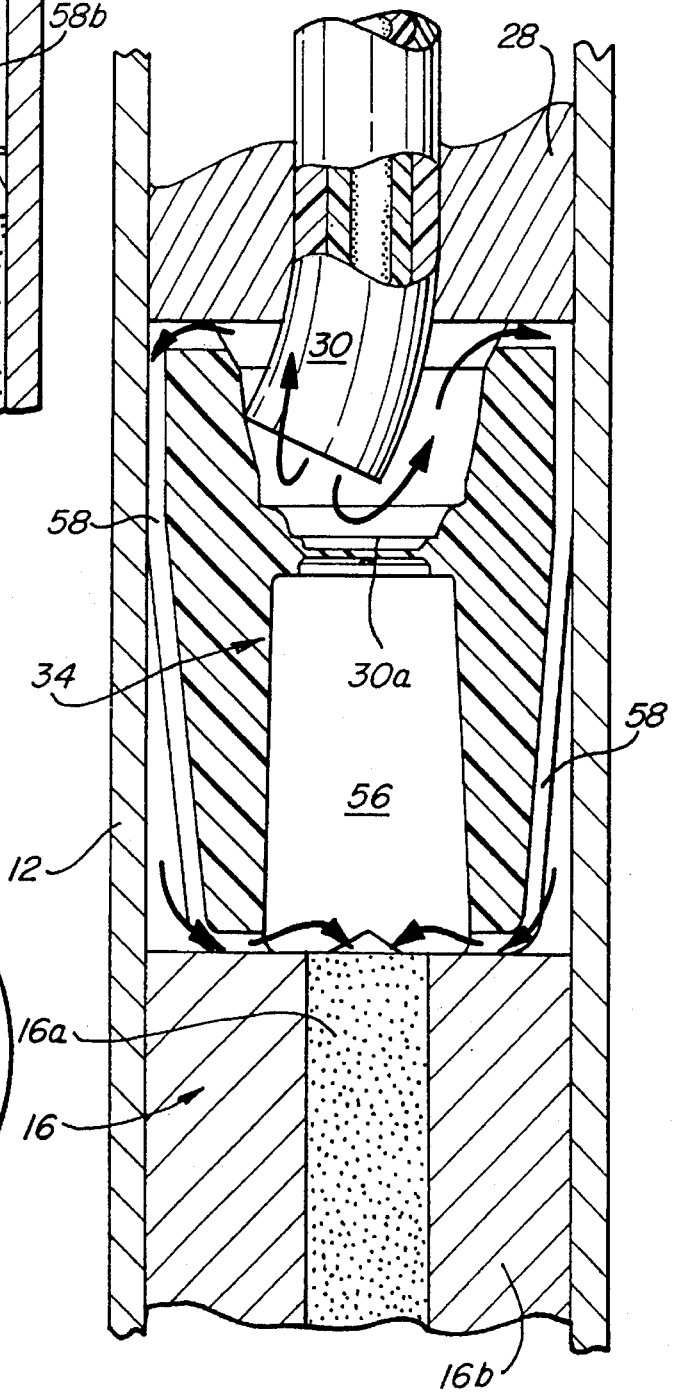
FIGS. 3A and 3B are views similar to FIG. 1C showing in FIG. 3A an alternate flow path about the isolation member and in FIG. 3B the impulse signal flow path and pressure relief flow path.
Figure 4A:
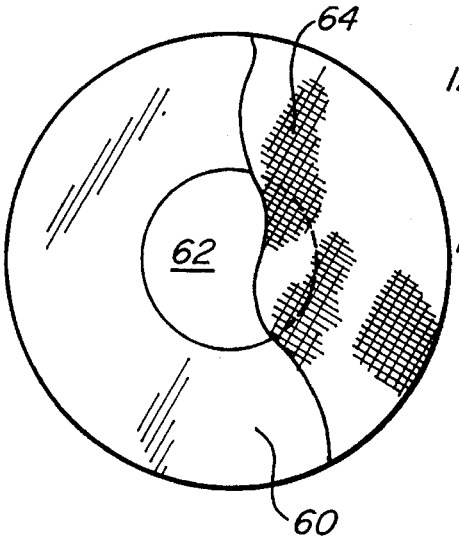
FIG. 4A is a plan view of a cushion element which is utilizable within a detonator cap between the isolation member and the receptor charge.

Firstly, the signal transmission line may be misaligned so that the signal-emitting end thereof will not be properly seated in the radial center of positioning region 44 of the isolation member. For example, shock tube is conventionally manufactured by an extrusion process and long lengths of the tube are taken up on reels or spools for storage. After a period of storage, the shock tube from the reels may be used in the manufacture of detonator caps as illustrated in FIGS. 1 and 1D by unwinding and cutting a length of the shock tube from the reel and securing it into a shell 12 in the manner described above and as illustrated in FIG. 1. Thus, shock tube 30, which in the embodiment of FIG. 3A is a small diameter shock tube, e.g., with an outside diameter of about 0.085 inch (about 2.159 millimeters, "mm"), is inserted through retainer bushing 28 and thence into positioning region 44 of isolation member 34. Centering shoulder 54 serves to help center shock tube 30 to facilitate seating thereof on shoulder 48 as illustrated in FIG. 1. Because the shock tube has been stored for a greater or lesser period of time on a reel it has a tendency to curl, especially those lengths of shock tube which are cut from close to the core of the reel as these have been stored in a very tightly curled configuration. Consequently, there is a tendency, especially with smaller diameter shock tube, for the inserted end of the shock tube to tend to curl out of alignment with the longitudinal axis of shell 12 and not to be inserted fully within the positioning region of the isolation member 34, as seen in FIG. 1C. This tendency is most pronounced with smaller diameter tubes, but conventional and even heavy-duty shock tube, the latter typically having an outer diameter of 0.150 inch (3.810 mm), are not immune to this condition. Thus, storage conditions of shock tube (or other signal transmission lines) may result in the shock tube assembled into the detonator cap being curved somewhat at its end so that the signal emitted from the shock tube may not be fired directly along the longitudinal center axis of the detonator cap 10 but may be deflected to one side or the other. As best appreciated from FIG. 3A, this may cause the signal to not directly strike the target provided in the illustrated embodiment by core 16*a*, but instead may cause all or part of the signal to strike the sheathing surrounding the core, resulting in a misfire.

When such misalignment occurs, the signal from shock tube 30, or at least a portion thereof, may be directed toward the interior wall of the cylindrical body of the isolation member and thus deflected away from, rather than towards, diaphragm 42. By providing an alternate signal flow path around the exterior of isolation member 34 indicated by the flow arrows (unnumbered) in FIG. 3A, a deflected signal may nonetheless reach the receptor charge by travelling along the exterior signal paths established by grooves 58, 58*a* and 58*b*. Similarly, the exterior signal paths may provide the only possible way for a signal to reach its receptor charge target should, due to another kind of manufacturing defect, the end of the signal transmission line be crimped in a position beyond isolation member 34 (above it, as viewed in FIG. 1) and so far from the diaphragm 42 that the signal fails to rupture the diaphragm 42. In such case, the only chance for initiation is for the signal to flow through the exterior signal path, generally as shown by the arrows in FIG. 3A.

Secondly, in some cases diaphragm 42 may fail to rupture or at least to rupture sufficiently when the initiation signal is emitted from shock tube 30 into positioning region 44. Such a complete or partial failure to rupture would eliminate or diminish the signal that reaches the target of the receptor charge via the interior passageway. In such case, the alternate flow path provided on the isolation member according to the present invention will provide an alternate pathway by which the shock wave signal from shock tube 30 can travel to detonator cap charge 14, in the same manner as for a misaligned tube illustrated in FIG. 3A.

Figure 4B:
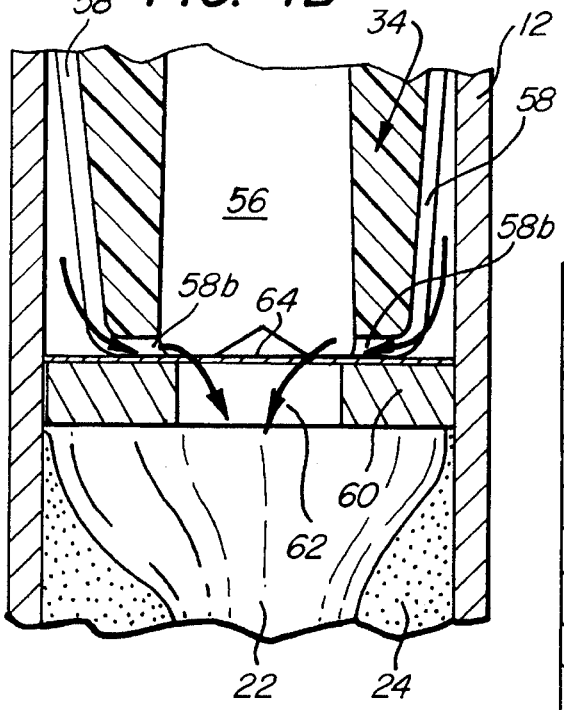
FIG. 4B is a view similar to FIG. 3A but showing only the portion thereof between the isolation member and receptor charge 14 with the cushion element interposed therebetween.

The alternate flow path is also efficacious in cases where a cushion element, such as disclosed in co-pending U.S. patent application Ser. No. 07/954,878, or the like is interposed between isolation member 34 and receptor charge 14, shown in FIG. 4B as comprising primary explosive charge 22. The cushion element 60 comprises a ring of an easily deformable but form-sustaining material which has a soft consistency for enhanced shock absorbence. Accordingly, cushion element 60 may be made of a material such as paperboard, or any other suitable material such as suitable polymeric materials, e.g., polyethylene, rubber, polyurethane and the like. The central aperture 62 of cushion element 60 and the cushion element itself may be covered by a thin membrane 64 which allows the initiating signal received from shock tube 30 or the like to readily pass therethrough. Thus, membrane 64 may comprise a thin, porous tissue paper adhered to one side of cushion element 60. Other suitable, non-metallic porous materials which are easily permeable to the initiating signal may be utilized as may non-porous, thin inert films such as cellulose acetate, or self-consuming materials such as thin films of high nitrogen content nitrocellulose, which decompose rapidly upon exposure to the initiating signal. As shown in FIG. 4B, the grooves 58, which extend across output end 38 (radial grooves 58*b*, best seen in FIG. 2), provide a flow path which enables the initiating signal, indicated by the unnumbered arrows in FIG. 4B, to traverse the solid ring of cushion element 60 and penetrate membrane 64 to impinge via aperture 62 upon the target provided, in the illustrated embodiment, by primary explosive charge 22. It is therefore seen that structures such as cushion element 60, or other annular structures interposed between the output end 38 of isolation member 34 and the receptor charge 14, pose no barrier to impingement of the signal on the receptor charge via the alternate, exterior flow path provided by the grooves 58. For other typical annular structures employed within detonator caps, see U.S. Pat. No. 4,821,646 issued Apr. 18, 1989 or its counterpart Canadian Patent 1,273,242 or Canadian published application 2,107,021, published Apr. 9, 1994.

Figure 3B:
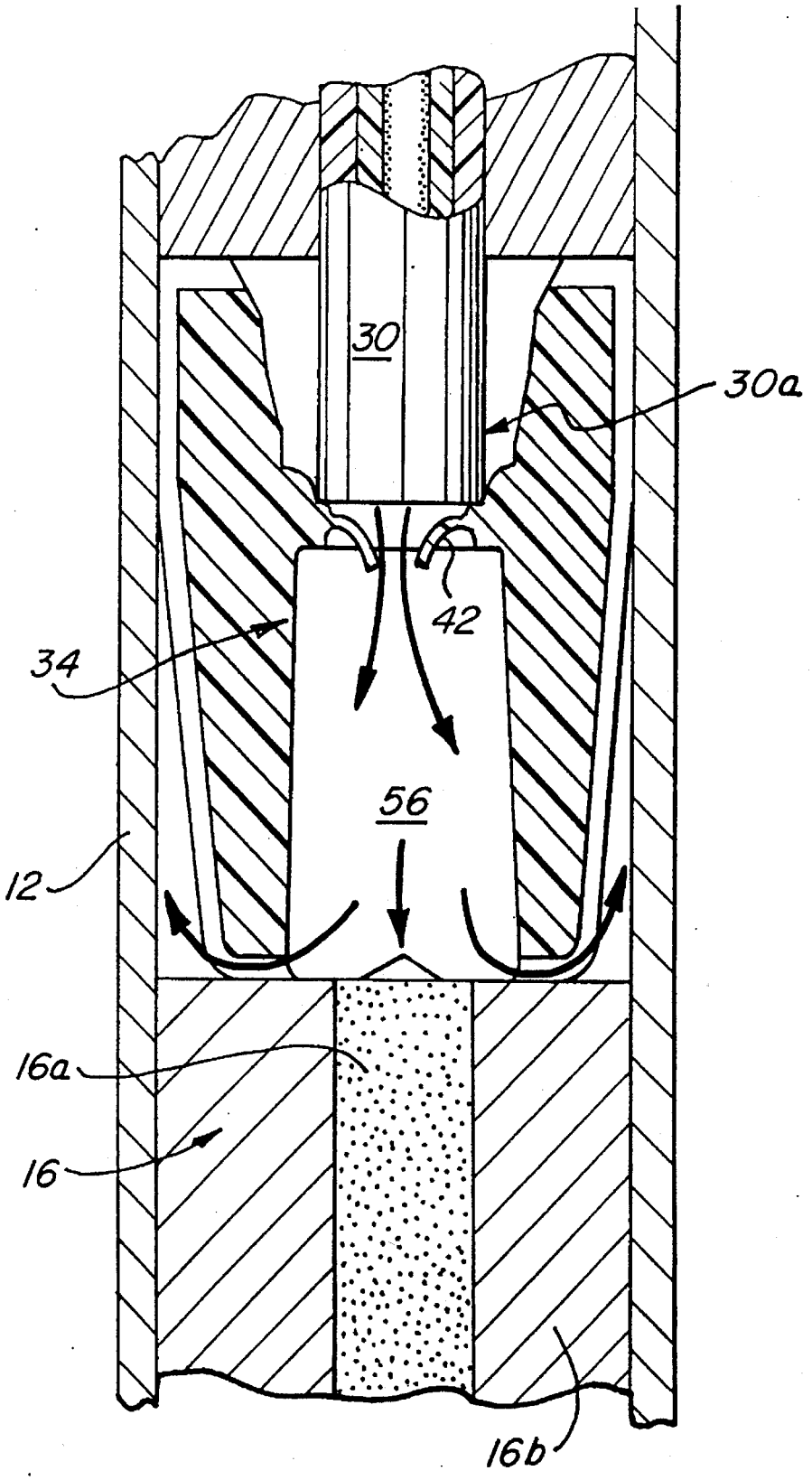

Thirdly, it is believed that the exterior signal flow path provided according to the present invention enhances the reliability even of a properly assembled and functioning detonator by providing a flow path by which air trapped beneath diaphragm 42 can escape from discharge port 56 when the initiation signal from the shock tube 30 bursts the diaphragm 42. As suggested in FIG. 3B by the flow arrows (unnumbered) in discharge port 56, air can be expelled via grooves 58*b* from discharge port 56 as the signal enters therein through ruptured diaphragm 42, and then flow via grooves 58 and 58*a*, so resistance to the transmission of the signal from the signal-emitting end 30*a* of the shock tube 30 is reduced.

While the illustrated embodiment features end grooves 58*a*, 58*b* that extend substantially radially along isolation member 34 and grooves 58 that extend longitudinally of isolation member 34, it will be understood that alterations to this configuration can be made in accordance with the present invention. For example, groove 58 on isolation member 34 need not run strictly longitudinally along the exterior surface of the isolation member but may be skewed or define a circuitous path, e.g., groove 58 may define a spiral path along the exterior of isolation member 34, and may thus run generally longitudinally along the surface of isolation member 34. Similarly, input end radial groove 58*a* and output end radial groove 58*b* need not be disposed in a strictly radial orientation; these too may define a skewed or circuitous path.

Although the objects of the invention may be achieved with an isolation member comprising an alternate flow path defined by a single signal path from the input end to the output end, it is preferable that the alternate flow path define a plurality of such paths, i.e., two or more, e.g., four, as shown in the Figures. In such case, it is preferred that the signal paths be disposed equiangularly about the longitudinal axis of the isolation member. For example, when the alternate flow path comprises four signal paths, they are preferably disposed at 90 degree radial angles relative to one another about the center of the isolation member, as seen in FIGS. 2, 2A and 2B.

The grooves that comprise the alternate flow path provide a cross-sectional flow area adequate to allow the initiation signal to travel therethrough with sufficient strength to ignite the cap charge 14, thus providing initiation signal communication between the input end of the body and the discharge port. Generally, the total cross-sectional flow area of the alternate flow path, whether provided by a single exterior groove or a plurality of grooves spaced about the isolation member, should correspond to at least about 20 percent of the smallest cross-sectional flow area of the interior passageway of the isolation member, e.g., measured at diaphragm 42 in the illustrated embodiments, the point of smallest cross-sectional flow area.

While the invention has been described in detail with respect to specific preferred embodiments thereof, it will be apparent to those skilled in the art that upon a reading and understanding of the foregoing that numerous variations and alterations may be made to the disclosed embodiments which nonetheless lie within the spirit and scope of the invention and the appended claims.

What is claimed is:

1. An isolation member for positioning the signal emitting end of a non-electric signal transmission line with the shell of a detonator cap comprises:

a substantially cylindrical body dimensioned and configured to be received within the shell of the detonator cap and having an exterior surface, an input end, an output end and an interior passageway extending through the body for transmission therethrough of an initiation signal from the input end to the output end of the body, the interior passageway defining a positioning region at the input end of the body and a discharge port at the output end of the body; and an alternate flow path comprising one or more grooves extending along the exterior surface and connecting the positioning region of the body in initiation signal communication with the discharge port.

2. The isolation member of claim 1 wherein the alternate flow path comprises one or more signal paths, each signal path comprising a generally longitudinally-extending groove formed in the exterior surface of the body, and an input radial groove at the input end of the body and an output radial groove at the output end of the body associated therewith, the associated input, longitudinal and output grooves being in initiation signal communication with each other to define one or more signal paths.

3. The isolation member of claim 1 wherein the alternate flow path comprises a plurality of signal paths spaced equiangularly about the circumference of the body.

4. The isolation member of claim 3 comprising four signal paths spaced at ninety-degree intervals about the circumference of the body.

5. The isolation member of claim 1 or claim 2 wherein the total cross-sectional flow area of the alternate flow path equals at least about 20 percent of the cross-sectional flow area of the interior passageway measured at its smallest point.

6. The isolation member of claim 1 having a signal-rupturable diaphragm disposed within the interior passageway to isolate the positioning region from the discharge port.

7. The isolation member of claim 1 wherein the body is substantially entirely comprised of a semi-conductive synthetic organic polymeric material.

8. A detonator cap for connection to a length of non-electric signal transmission line terminating in a signal-emitting end, the cap comprising:

an elongated shell having an open end for receiving the non-electric signal transmission line and an opposite, closed end;

a retainer bushing positioned in the open end of the shell and having a bore extending therethrough for receiving therein a segment of the length of signal transmission line to connect the same to the shell with the signal-emitting end of the transmission line enclosed within the shell;

a receptor charge positioned within the shell and disposed between the bushing and the closed end of the shell and axially spaced from the bushing; and an isolation member disposed within the shell between the bushing and the receptor charge and comprising a substantially cylindrical body having an exterior surface, an input end facing the open end of the shell, an output end facing the closed end of the shell and an interior passageway extending through the body, the interior passageway defining a positioning region at the input end of the body and a discharge port at the output end of the body, and an alternate flow path comprised of one or more signal paths, each signal path comprising a groove extending along the exterior surface and connecting the positioning region in initiation signal communication with the discharge port.

9. The detonator cap of claim 8 further including a length of signal transmission line connected to the shell and extending through the bore of the bushing with the signal-emitting end of the transmission line seated in the positioning region.

10. The detonator cap of claim 8 or claim 9 wherein the alternate flow path comprises one or more longitudinally-extending grooves formed in the exterior surface of the body, each longitudinal groove having an input radial groove at the input end of the body, and an output radial groove at the output end of the body associated therewith, the associated input, longitudinal and output grooves being in initiation signal communication with each other to define one or more signal paths.

11. The detonator cap of claim 10 wherein the alternate flow path comprises a plurality of signal paths spaced equiangularly about the circumference of the body.

12. The detonator cap of claim 11 wherein four signal paths are spaced at ninety-degree intervals about the circumference of the body.

13. The detonator cap of claim 10 wherein the total cross-sectional flow area of the alternate flow path equals at least about 20 percent of the cross-sectional flow area of the interior passageway measured at its smallest point.

14. The detonator cap of claim 10 wherein the isolation member has a signal-rupturable diaphragm disposed within the interior passageway to isolate the positioning region from the discharge port.

15. The detonator cap of claim 10 wherein the isolation member is substantially entirely comprised of a semi-conductive synthetic organic polymeric material.

* * * * *

UNITED STATES PATENT AND TRADEMARK OFFICE

CERTIFICATE OF CORRECTION

PATENT NO. : 5,501,151
DATED : March 26, 1996
INVENTOR(S) : Gary R. Thureson et al It is certified that error appears in the above-indentified patent and that said Letters Patent is hereby corrected as shown below:

In column 5, line 42, replace "sig- nal-" with --signal- --;
line 66, replace "β" with --α--.

Signed and Sealed this

Sixth Day of August, 1996

*Attest:*

*Attesting Officer*

BRUCE LEHMAN

*Commissioner of Patents and Trademarks*